US011117693B2

(12) United States Patent
Peccetti

(10) Patent No.: US 11,117,693 B2
(45) **Date of Patent: *Sep. 14, 2021**

(54) PACKAGING METHOD AND MACHINE IN EXTENSIBLE FILM OF PRODUCTS FED IN CONTINUOUS

(71) Applicant: Colines S.p.A., Novara (IT)

(72) Inventor: Francesco Peccetti, Sizzano (IT)

( * ) Notice: Subject to any disclaimer, the term of this patent is extended or adjusted under 35 U.S.C. 154(b) by 126 days.

This patent is subject to a terminal disclaimer.

(21) Appl. No.: 16/067,571

(22) PCT Filed: Feb. 3, 2017

(86) PCT No.: PCT/EP2017/052346

§ 371 (c)(1),
(2) Date: Jun. 29, 2018

(87) PCT Pub. No.: WO2017/137318

PCT Pub. Date: Aug. 17, 2017

(65) Prior Publication Data

US 2019/0023430 A1 Jan. 24, 2019

(30) Foreign Application Priority Data

Feb. 9, 2016 (IT) ..... 102016000012911

(51) Int. Cl.
*B65B 11/00* (2006.01)
*B65B 11/58* (2006.01)
(Continued)

(52) U.S. Cl.
CPC ..... *B65B 11/008* (2013.01); *B65B 11/58* (2013.01); *B65B 21/245* (2013.01); *B65B 61/10* (2013.01);
(Continued)

(58) Field of Classification Search
CPC ..... B65B 11/008; B65B 11/58; B65B 21/245; B65B 21/06; B65B 61/10; B65B 35/30;
(Continued)

(56) References Cited

U.S. PATENT DOCUMENTS 2,109,505 A * 3/1938 Rue ..... B65B 51/00 53/49
3,758,366 A 9/1973 Tosarelli
(Continued)

FOREIGN PATENT DOCUMENTS

| | | |
|---|---|---|
| EP | 0304979 | 3/1989 |
| WO | 2012055490 | 5/2012 |
| WO | 2015040565 | 3/2015 |

*Primary Examiner* — Valentin Neacsu
(74) *Attorney, Agent, or Firm* — Themis Law

(57) ABSTRACT

A packaging method includes feeding products, ordered into two rows, into a first ring winding unit of extensible film and winding the products in a first film having a first rotation direction to form a continuous packaging or bundle; feeding the wound products to a second ring winding unit of extensible film in a second film having a second rotation direction opposite to the first rotation direction to form a continuous packaging or bundle with two layers of film; and feeding the continuous packaging or bundle into a cutting unit, which moves in synchrony with, and cuts, the continuous packaging or bundle transversely into finished groups of products. A ring winding machine is provided at each of the two ring winding units, obtaining a continuous winding also when the film becomes exhausted in at least one of the two ring winding machines. A packaging machine is also provided.

13 Claims, 16 Drawing Sheets

(51) Int. Cl.

| | |
|---|---|
| ***B65B 21/24*** | (2006.01) |
| ***B65B 61/10*** | (2006.01) |
| *B65B 21/06* | (2006.01) |
| *B65B 35/44* | (2006.01) |
| *B65B 35/30* | (2006.01) |

(52) U.S. Cl.
CPC ..... *B65B 21/06* (2013.01); *B65B 35/30* (2013.01); *B65B 35/44* (2013.01); *B65B 2210/18* (2013.01)

(58) Field of Classification Search
CPC ..... B65B 35/42; B65B 35/44; B65D 2571/00685; B65D 2571/00679; B26D 1/045; B26D 1/385; B26D 1/06; B26D 1/015; B26D 1/03; B26D 1/035; B26D 1/065; B26D 1/08; B26D 1/085; B26D 1/09; B26D 1/095
USPC .... 53/441, 442, 461, 543, 588, 582; 83/620, 83/622, 697
See application file for complete search history.

(56) References Cited

U.S. PATENT DOCUMENTS

| | | | | | |
|---|---|---|---|---|---|
| 4,050,220 | A | | 9/1977 | Lancaster | |
| 4,422,281 | A | * | 12/1983 | Rensner | B65B 61/14 53/134.1 |
| 4,549,388 | A | | 10/1985 | Lancaster | |
| 4,655,028 | A | | 4/1987 | Silbernagel | |
| 4,712,354 | A | | 12/1987 | Lancaster | |
| 4,723,393 | A | * | 2/1988 | Silbernagel | B65B 11/008 53/556 |
| 4,730,436 | A | * | 3/1988 | Angelino | B65B 11/58 53/170 |
| 4,738,079 | A | | 4/1988 | Lancaster | |
| 4,953,336 | A | | 9/1990 | Lancaster | |
| 5,531,061 | A | * | 7/1996 | Peterson | A01F 15/071 53/133.8 |
| 2008/0047232 | A1 | | 2/2008 | Kovacs | |
| 2016/0207651 | A1 | * | 7/2016 | Cattaneo | B65B 11/58 |

* cited by examiner

PACKAGING METHOD AND MACHINE IN EXTENSIBLE FILM OF PRODUCTS FED IN CONTINUOUS

FIELD OF THE INVENTION

The present invention relates to a packaging method and machine in extensible film of products fed in continuous.

BACKGROUND OF THE INVENTION

In the packaging field of various types of products such as, for example, bottles, boxes having varying formats, etc., a film made of heat-shrinkable plastic material is currently most commonly used. This film is wound around the product or group of products, then welded and cut to size and subsequently treated in a heat-shrinking oven which stabilizes the packaging thus produced, stably holding the products.

This technique involves a certain cost for plastic material having a certain thickness, due to the energy used for the heat shrinking, in addition to a plant cost requiring the presence of a packaging machine and a relative heat-shrinking oven associated with the same.

Alternatively, an extensible plastic film is used, which is spirally wound around the products that are moved forward in a horizontal direction. The products are divided into groups and selectively wound in correspondence with a winding unit. In said winding unit, a reel of extensible plastic film is caused to rotate around the products advancing along a conveyor belt or roller and when the winding has been completed, the packaging thus obtained is discharged. In this packaging unit, a reel-holder trolley is provided which is moved along a circular guide on a plane perpendicular to the advance direction around the products being packaged. It can be immediately seen that this technique requires continuous stoppages for the formation of each packaging with problems associated with the connection of the head of the film to the products to be packaged and cutting of the packaged product.

Furthermore, the packaging requires times that are certainly not short due to this alternative movement.

Packaging in film made of extensible plastic material, on the other hand, eliminates the necessity of a heat-shrinking oven and the energy costs associated therewith, it allows the use of a thinner film with a cost reduction, but at present is not satisfactory due to the times for reaching the final packaging.

WO 2015/040565 discloses equipment used for the packaging of bottles with a thin film made of extensible plastic material which is spirally wound having an entrainment station comprising pairs of conveyor belts and also pairs of disc plates.

SUMMARY OF THE INVENTION

The general objective of the present invention is to provide a packaging method and machine in extensible film of products, that is able to solve the drawbacks of the known art described above in an extremely simple, economical and particularly functional manner.

A further objective of the present invention is to provide a packaging method and machine that can function practically in continuous, eliminating any type of stoppage in the packaging phase.

Another objective of the invention is to provide a packaging machine of products which, by using an extensible film, also reduces costs relating to the packaging material.

BRIEF DESCRIPTION OF THE DRAWINGS

The structural and functional characteristics of the present invention and its advantages with respect to the known art will appear even more evident from the following description, referring to the enclosed schematic drawings, which show an embodiment example of the same invention. In the drawings.

DETAILED DESCRIPTION OF EMBODIMENTS OF THE INVENTION

Figure 1:
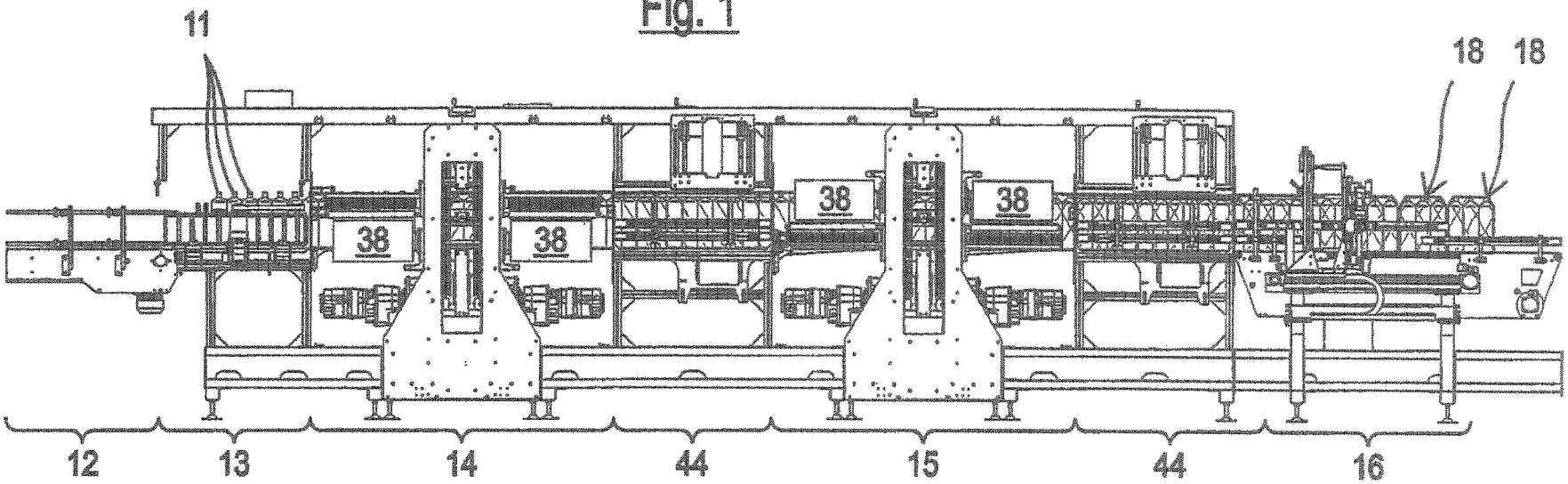
FIG. 1 is a raised side view illustrating a packaging machine in extensible film of products according to the invention.
Figure 2:
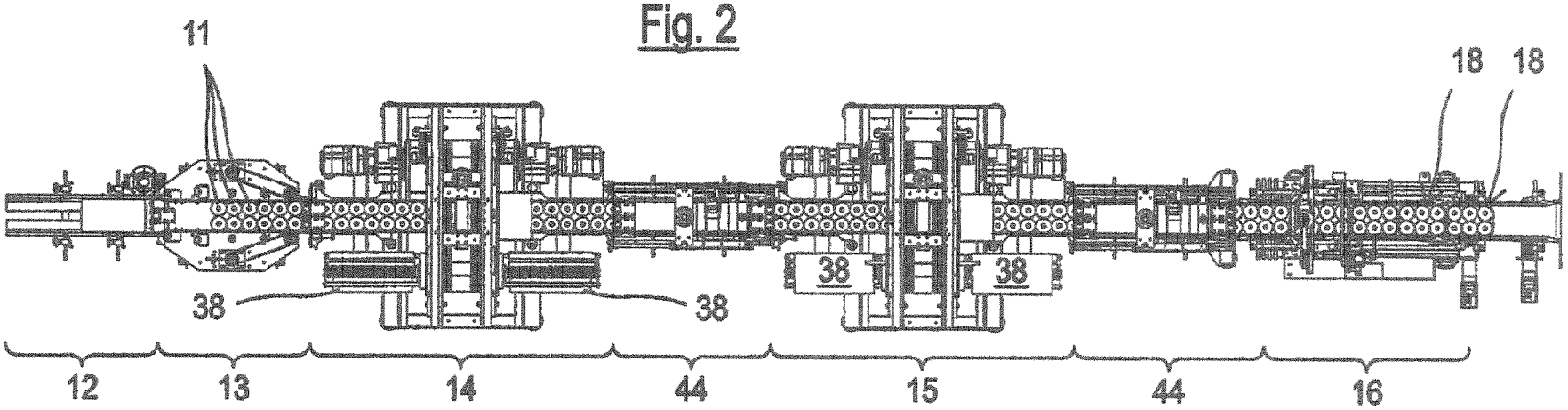
FIG. 2 is a plan view from above of the packaging machine in extensible film of products according to the invention, of FIG. 1.
Figure 3:
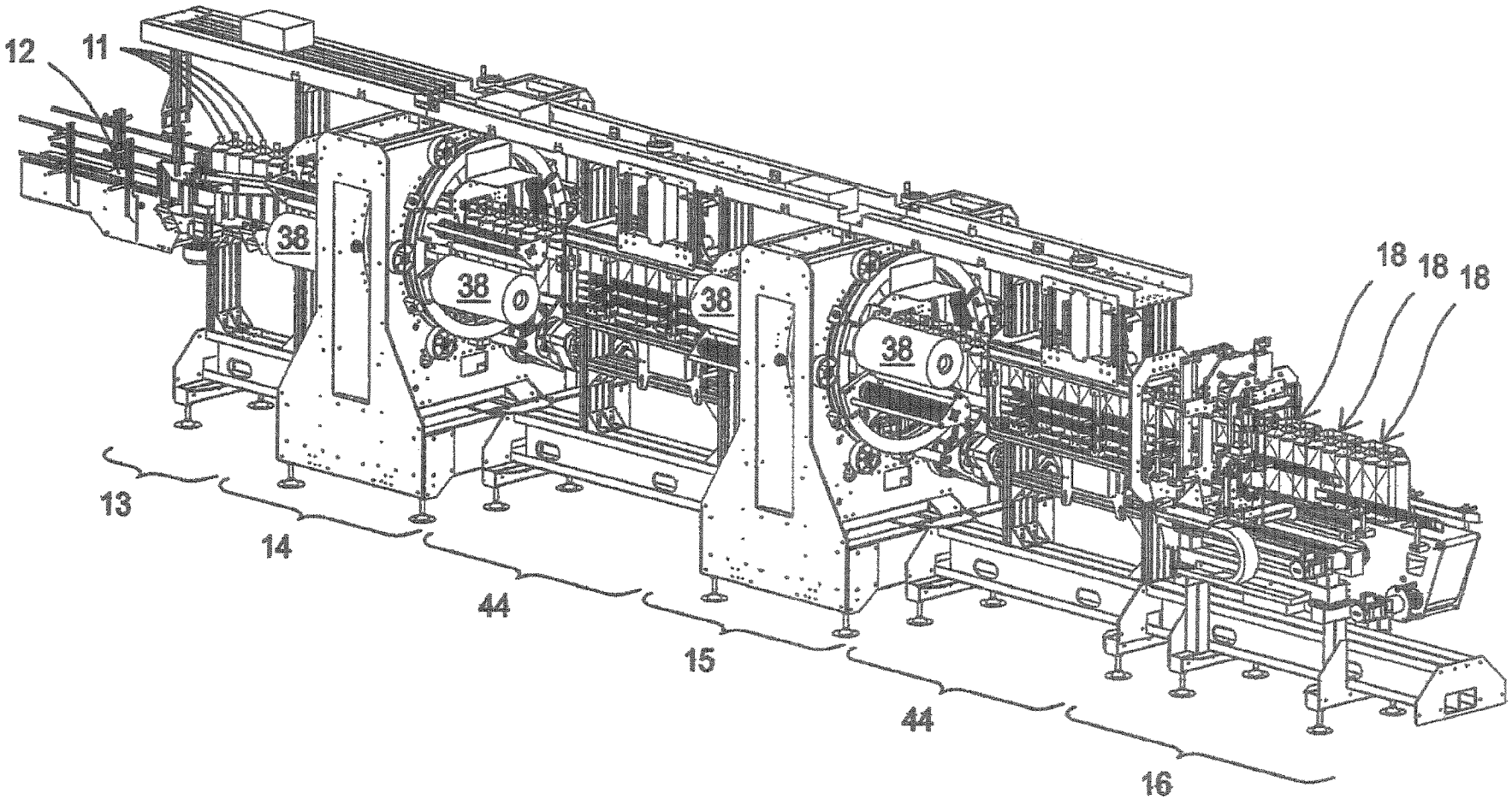
FIG. 3 is a perspective view of the packaging machine of FIG. 1, according to the invention.
Figure 4:
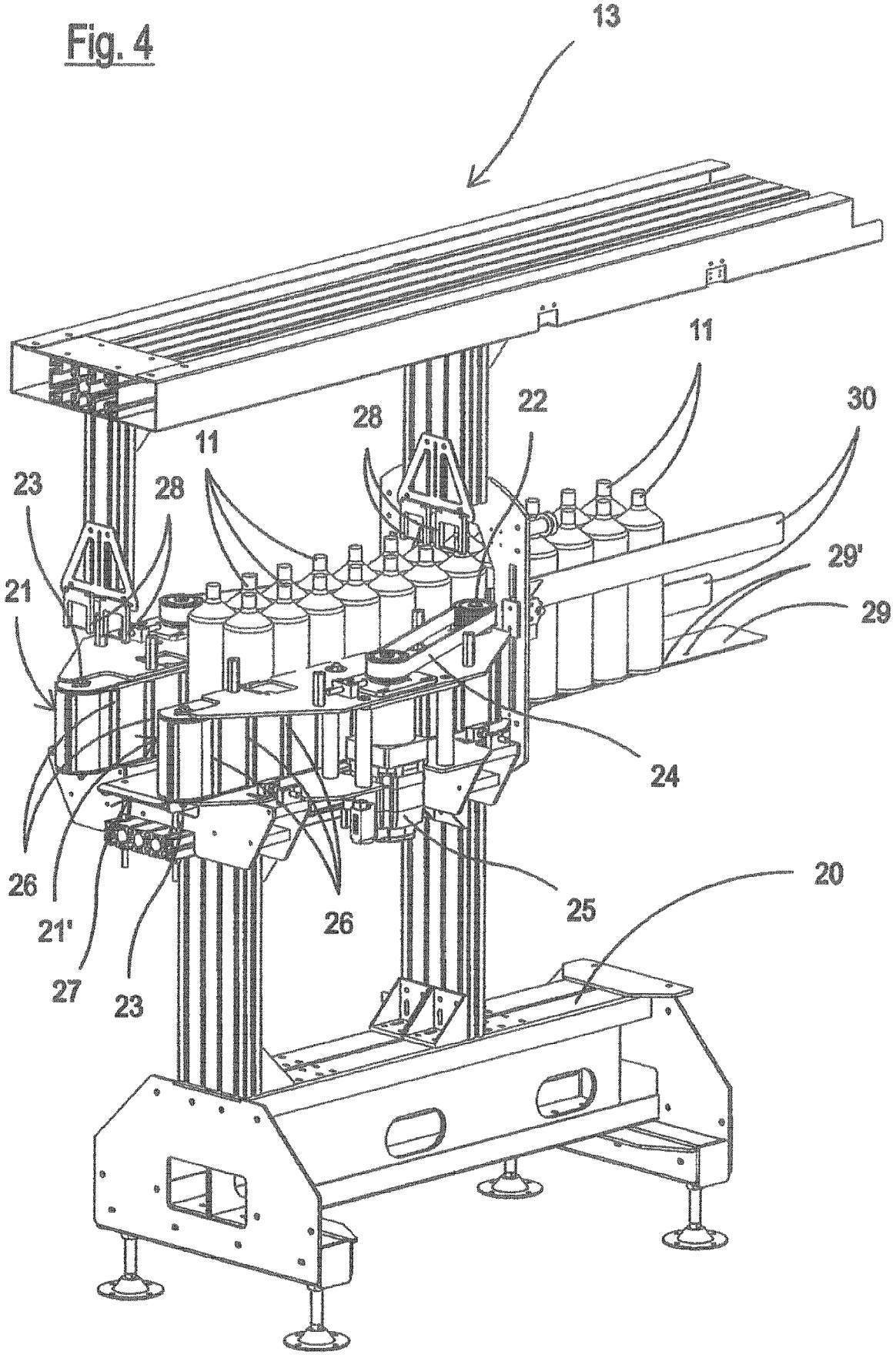
FIG. 4 is a perspective view of an ordering unit forming part of the machine of FIG. 1.
Figure 5:
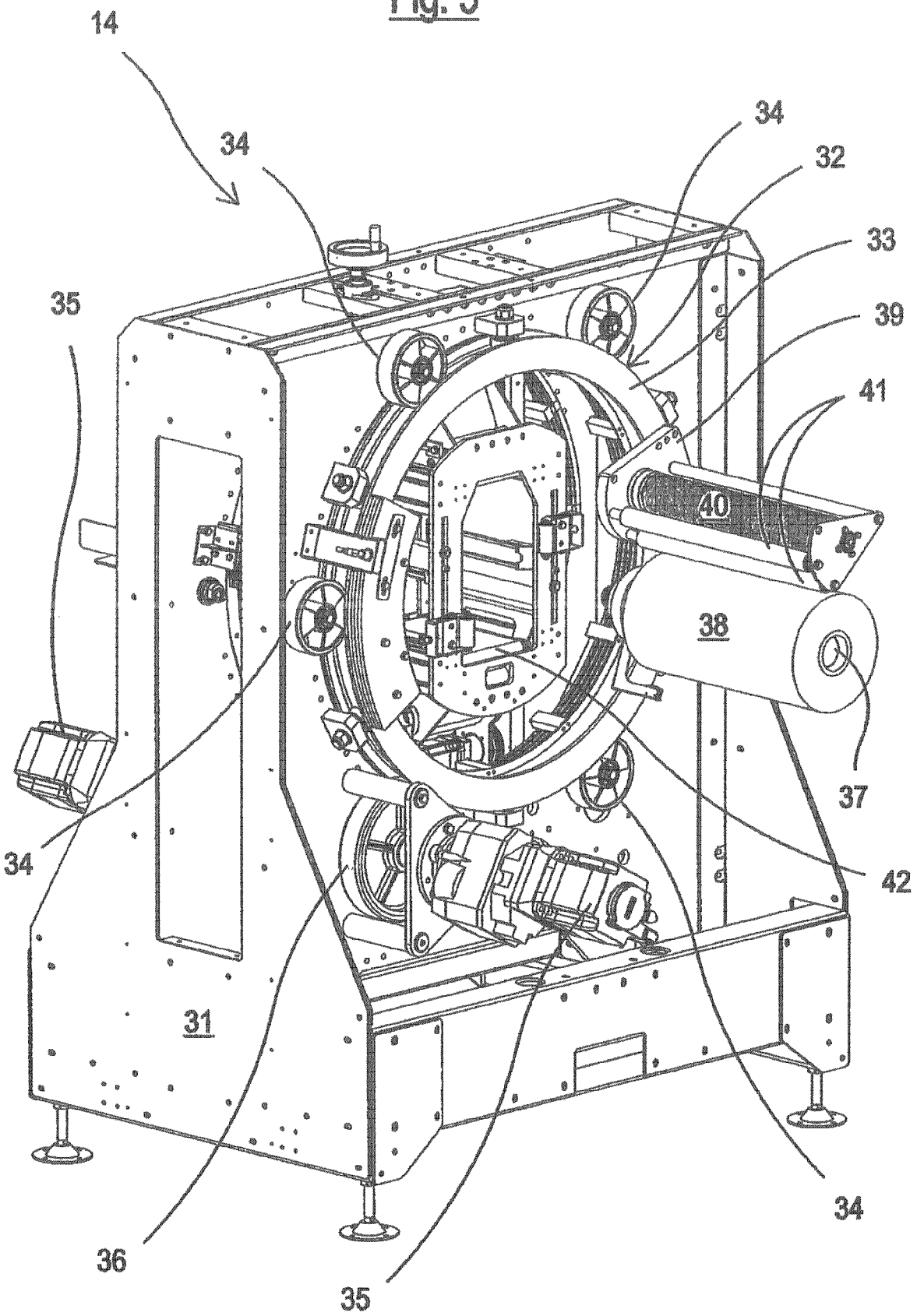
FIGS. 5 and 6 are two perspective views of a winding unit of the machine of FIG. 1.
Figure 6:
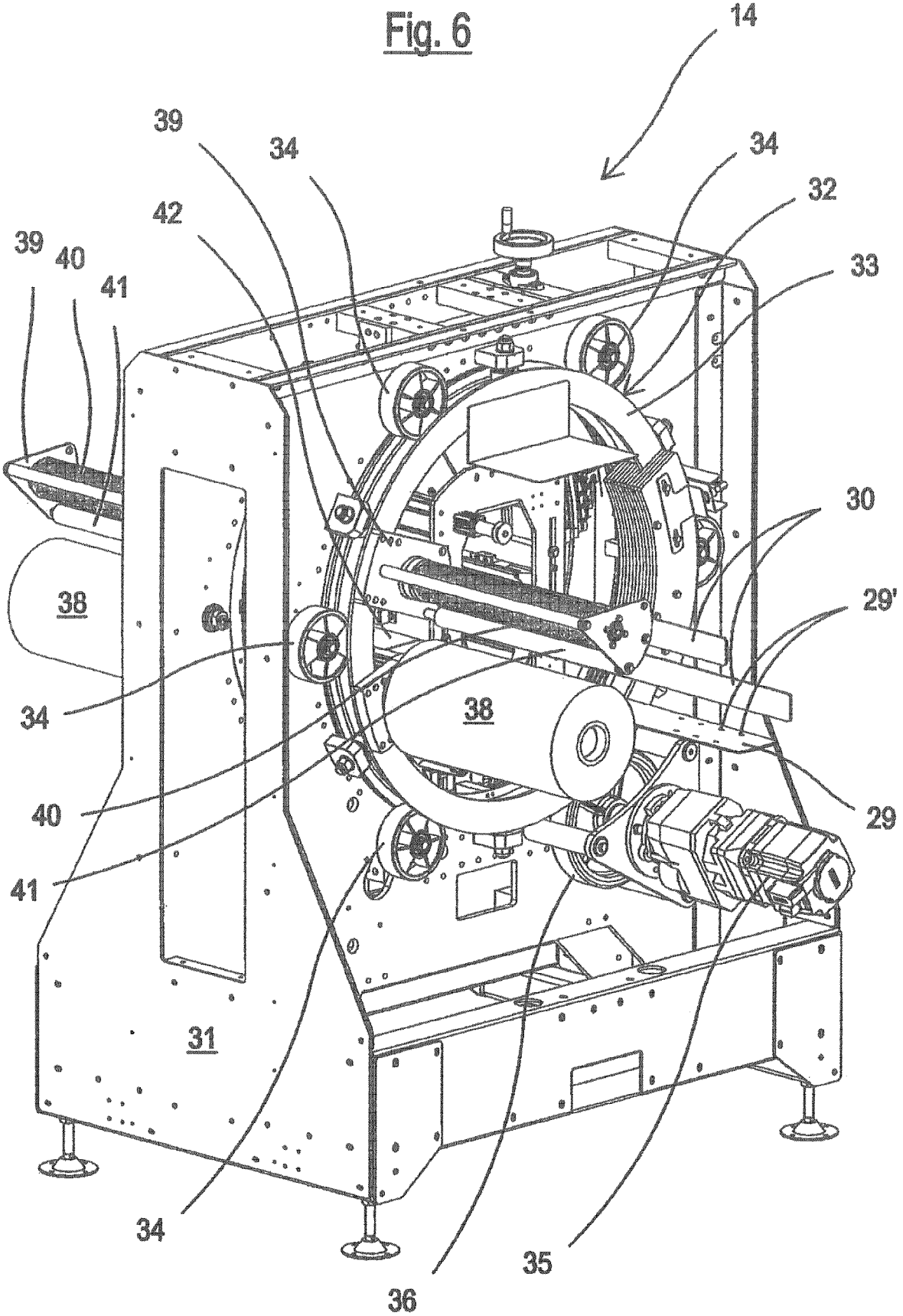
Figure 7:
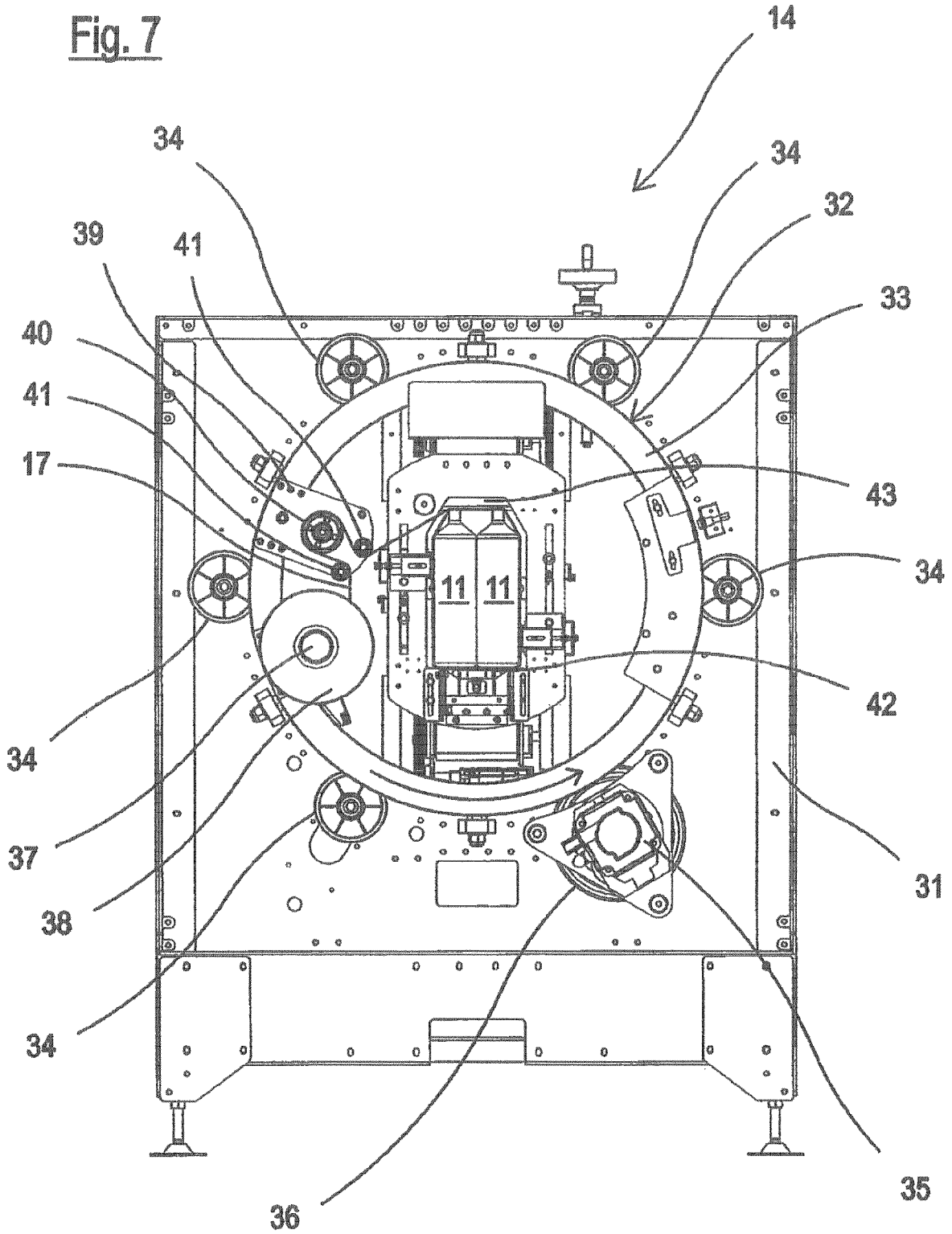
FIGS. 7 and 8 are transversal sectional views in correspondence with the winding unit of the previous FIG. 6 in addition to a second winding unit of the machine in the same operating position showing the different arrangement of the reel of film of extensible plastic material and the rubberized tensioning roller.

With reference to the figures, these show a packaging machine in extensible film of products fed forwards and in continuous in pairs, such as bottles or other objects 11.

It should be noted that upstream of said machine, the products, such as bottles or other objects 11, are arranged in two adjacent, aligned and continuous rows, moved forward up to a conveyor belt 12 for feeding the packaging machine.

An ordering machine 13 receives the two continuous and rows of adjacent bottles from said conveyor belt 12 and keeps them thus ordered up to a first ring winding unit 14.

The first ring winding unit 14 is then followed by a second ring winding unit 15, opposite the first unit 14, which effects a winding in an opposite direction with respect to the first winding unit 14 to produce a continuous packaging or bundle. The second winding unit is in turn followed by a cutting unit 16 of the continuous packaging into finished groups of products 11, wound in the film of extensible plastic material 17 and forming a final packaging 18.

In particular, the ordering unit 13 has the function of introducing the pair of adjacent and ordered bottles 13, braking the bottles 11 present on the conveyor belt 12 upstream and pushing the pairs of bottles 11 downstream towards the first winding unit 14.

In the example shown, said ordering unit 13 comprises a frame 20 carrying two belts 21, 21' ring-wound around end pulleys arranged on respective vertical axes 22, 23, one of said axes 22 being motorized by means of a toothed belt 24 driven by a gearmotor 25. The belts 21, 21' are toothed by means of spaced dowels 26 protruding from one belt 21 towards the other belt 21' opposite and facing the same. One belt 21 is spaced with respect to the other opposite belt 21' by a dimension equal to at least two adjacent bottles or products 11. A lower transfer and sliding plane 27 supports the various pairs of bottles 11 moving forward. Seven/eight pairs of bottles 11 are positioned, for example, between the rotation axes 22, 23 of the two belts 21, 21'. Each pair of bottles 11 is arranged between two pairs of subsequent dowels 26 of each belt 21, 21', said dowels 26 being inserted in the space left by the shape of the bottles 11 exerting a double action. When exiting from the pair of belts 21, 21', in fact, the dowels 26 push the bottles 11 moving forward and when entering the pair of belts 21, 21', the dowels 26 brake the bottles 11 coming from the feeding of the line to keep them correctly in order. The dowels 26 of a first belt 21 naturally collaborate with the dowels 26 provided on the second opposite belt 21', which is facing and in phase with the first belt 21.

Sensors 28 are positioned at the inlet and outlet of said ordering unit 13 to verify whether the bottles 11 are present and correctly aligned and if this is not the case, they stop the advance movement. The advance rate is modulated in relation to the filling degree of the line so as to avoid stoppages as much as possible. The ordering unit 13 at the inlet of the packaging machine determines the velocity for all the units downstream and for the velocity of the winding units 14 and 15, which must move at a synchronized rate.

At the outlet of said ordering unit 13, the pairs of adjacent bottles 11 advance one after another on a shelf 29 arranged cantilevered and extending from the frame 20, according to the advance direction of the bottles. The shelf 29 connects the ordering unit 13 with the subsequent first winding unit 14. Pairs of side guiding bars 30, also cantilevered from the frame 20, keep the succession of pairs of bottles 11 leaving the ordering unit 13, compact and ordered up to the first winding unit 14.

The shelf 29 arranged cantilevered from the frame 20 is internally hollow in order to allow holes 29' on its upper surface to form an air cushion to facilitate the sliding of the film when it slips off from the shelf 29 before moving forward and passing into the subsequent winding unit.

The first winding unit 14 comprises a frame 31, positioned astride with respect to the row of pairs of bottles 11 moving forward, which, on opposite sides, supports two ring winding machines 32, the same but opposite.

Each ring winding machine 32 comprises a ring or fifth wheel 33 which rotates with respect to guiding rollers 34, positioned on the frame 31. Said ring 33 is arranged on a plane perpendicular to the advance movement of the bottles 11. A gearmotor 35 integral with the frame 31 controls the rotation of the ring 33 by means of a command-friction roller 36.

A reel-holder 37 for a reel 38 of film of extensible plastic material 17, is assembled integral with each ring 33. A support 39 of a rubberized tensioning roller 40 and a pair of return rollers 41 for the film 17 are associated with said reel-holder 37.

The tension of the film 17 being unwound can be regulated by means of a brake (not shown) which acts directly on said rubberized tensioning roller 40. In this way, during the winding process of the film around the bottles 11, the rotating ring 33 rotates with a variable rotation rate to allow the deposition of the correct quantity of film in relation to the advancement rate of the bottles 11. As already mentioned, there are advantageously two rings 33 for each winding unit 14; one rotates and the other is stationary during the operating phase. When the reel 38 positioned on the ring 33 that is rotating, is running low, the second ring 33 is activated to rotate with a full reel 38. The first ring 33 is stopped and the exhausted reel 38 can be substituted without stopping the whole machine.

This allows an operating continuity even when the film of one reel ends and the winding unit does not have to be stopped in order to replace the reel. It is in fact stated that when the film of one winding ring 33 ends, the other ring 33 begins to operate, thus enabling the reel to be substituted without stopping the process.

It should be noted that two conveyor belts, a lower belt 42 and an upper belt 43 with separate motorization, are provided inside the frame 31 of the winding unit of the bottles 11, in the area between the two rotating rings 33. The conveyor belts 42 and 43 are conceived for entraining the bottles from the first to the second ring 33 of the first winding unit 14 or in any case forwards, passing inside the frame 31, to assist the thrust exerted by the ordering unit 13.

Furthermore, the frame 31 at the outlet of the first winding unit, in the advance direction of the bottles 11, provides an arrangement identical to that at the outlet of the ordering unit 13. This arrangement is provided either simply for the support and advancing of the partial packaging produced by the ring winding machine 32 at the inlet of this winding unit or for supporting the bottles when they are being wound in the film effected with the second ring winding machine which also forms part of this winding unit 14. Also in this case, in fact, a shelf 29 is provided, which is arranged cantilevered and extending from the frame 31, according to the advance direction of the bottles, connecting the first winding unit 14 to a connection module 44 with the subsequent second winding unit 15. Also in this case, pairs of side guiding bars 30 are provided, also cantilevered from the frame 31, which keep the succession of pairs of bottles 11 leaving the first winding unit 14, compact and ordered.

The connection module 44 provides, in a frame 49, two conveyor belts spaced apart and superimposed, a lower belt 45 and an upper belt 46, with separate motorization, and two pairs of side guiding bars 30. An upper motorization and a lower motorization are in fact provided, effected by means of pairs of toothed wheels 47, wherein a toothed wheel for each pair is actuated by a gearmotor 48. Said belts 45 and 46 are conceived for entraining the bottles wound with the film of the first winding unit 14 thus easing the thrust caused by the ordering unit 13.

It should be pointed out that, at the outlet of said connection module 44, in the advance direction of the bottles 11, an identical arrangement is provided as that at the outlet of the ordering unit 13 and the first winding unit 14. A shelf 29 is in fact provided, which is arranged cantilevered and extending from the frame 49, connecting the connection module 44 to the second winding unit 15 and also two pairs of side guiding bars 30, also cantilevered from the frame 49, which keep the partially wound advancing pairs of bottles 11, compact and ordered.

The second winding unit 15, identically to the first winding unit 14, comprises a frame 31, positioned astride with respect to the row of pairs of bottles 11 moving forward, wound with the film of the first winding unit. The second winding unit 15 also provides two ring winding machines 32 on opposite sides, which, in this case, are selectively actuated in relation to whether or not the reel is running low. It should also be noted that both of the rings 33 of this second winding unit 15 rotate in an opposite direction with respect to the rings provided in the first winding unit 14.

A second winding of the bottles 11 with film is therefore effected, positioned above the film previously wound. An intersection of layers of film is thus obtained, which serves to stabilize the packaging when finished with superimposed layers of film and wound in two opposite rotation directions.

Figure 8:
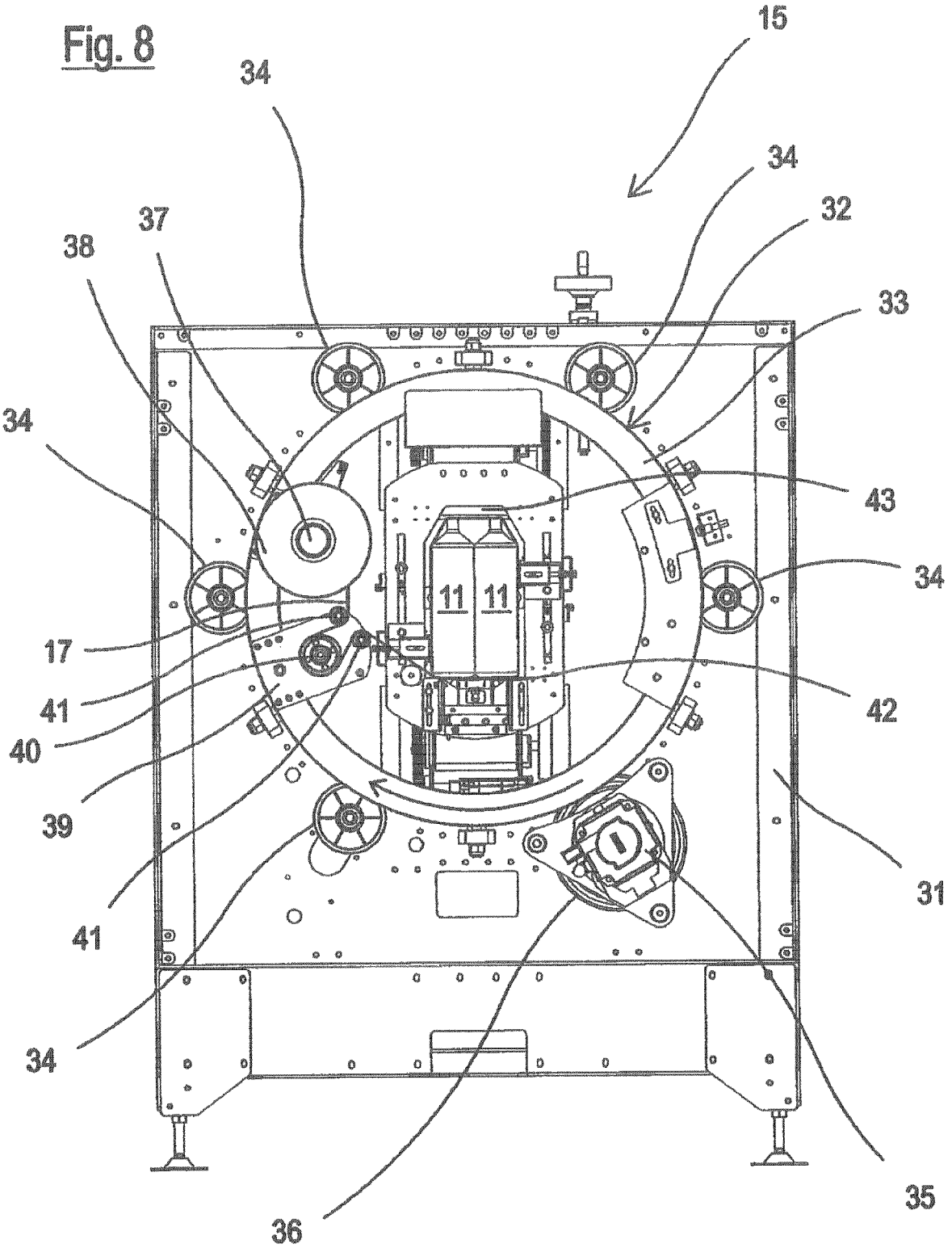
Figure 9:
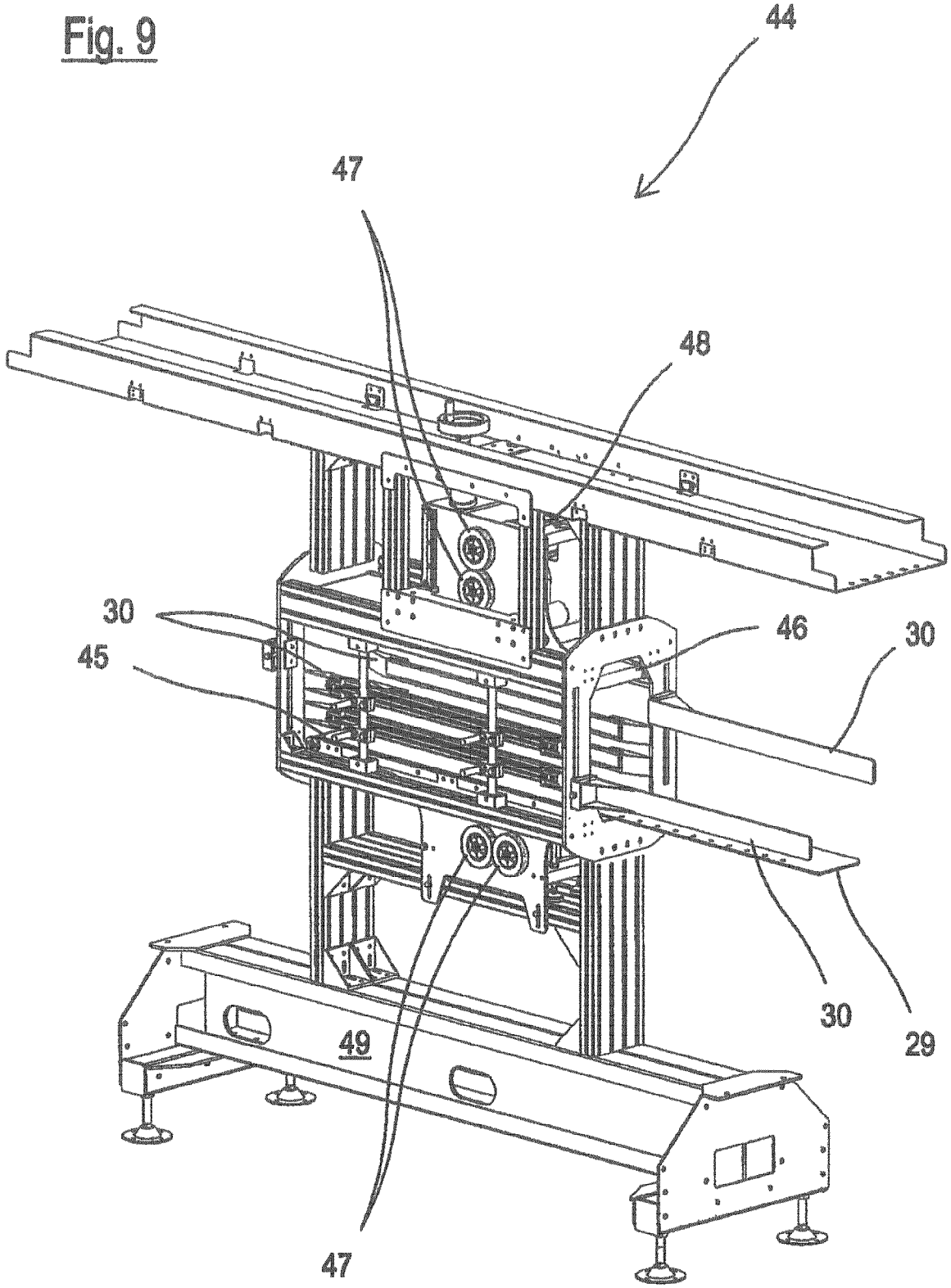
FIG. 9 is a perspective view of a connection unit between a first and a second winding unit of the machine of FIG. 1, without products.
Figure 10:
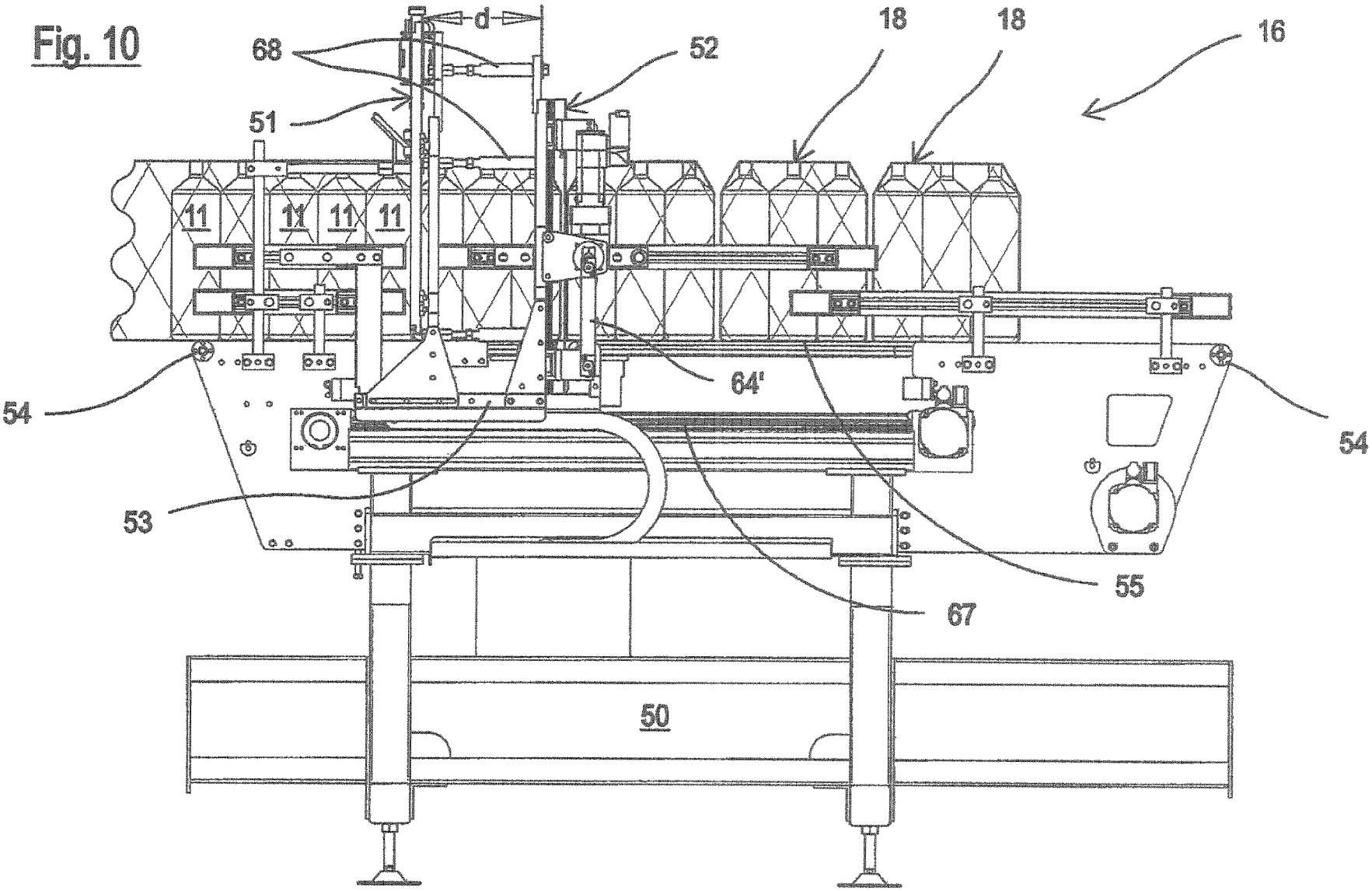
FIG. 10 is a raised side view showing the whole cutting unit forming part of the machine of FIG. 1.
Figure 11:
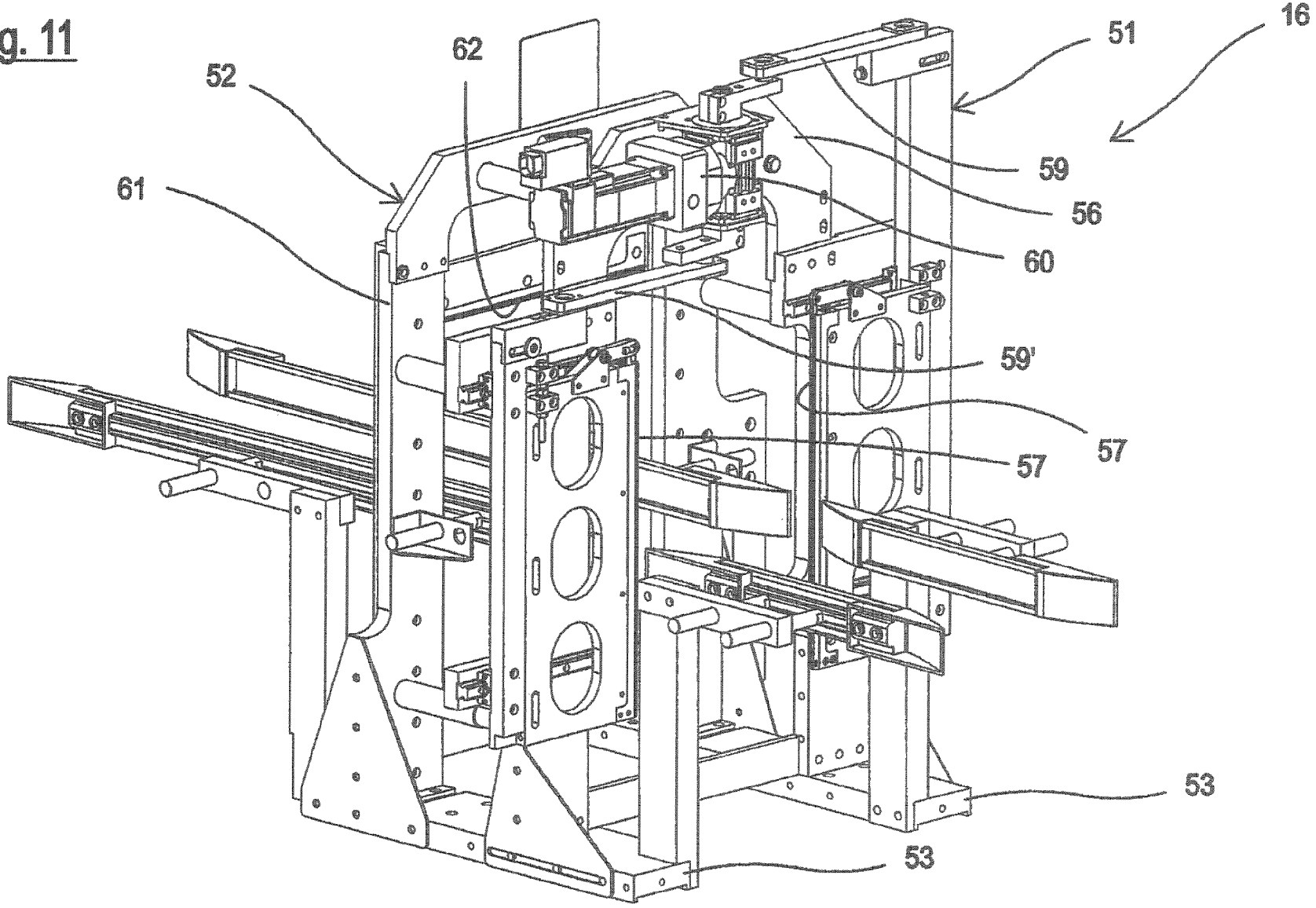
FIGS. 11 and 12 are perspective views of part of the cutting unit shown in FIG. 10, without products.
Figure 12:
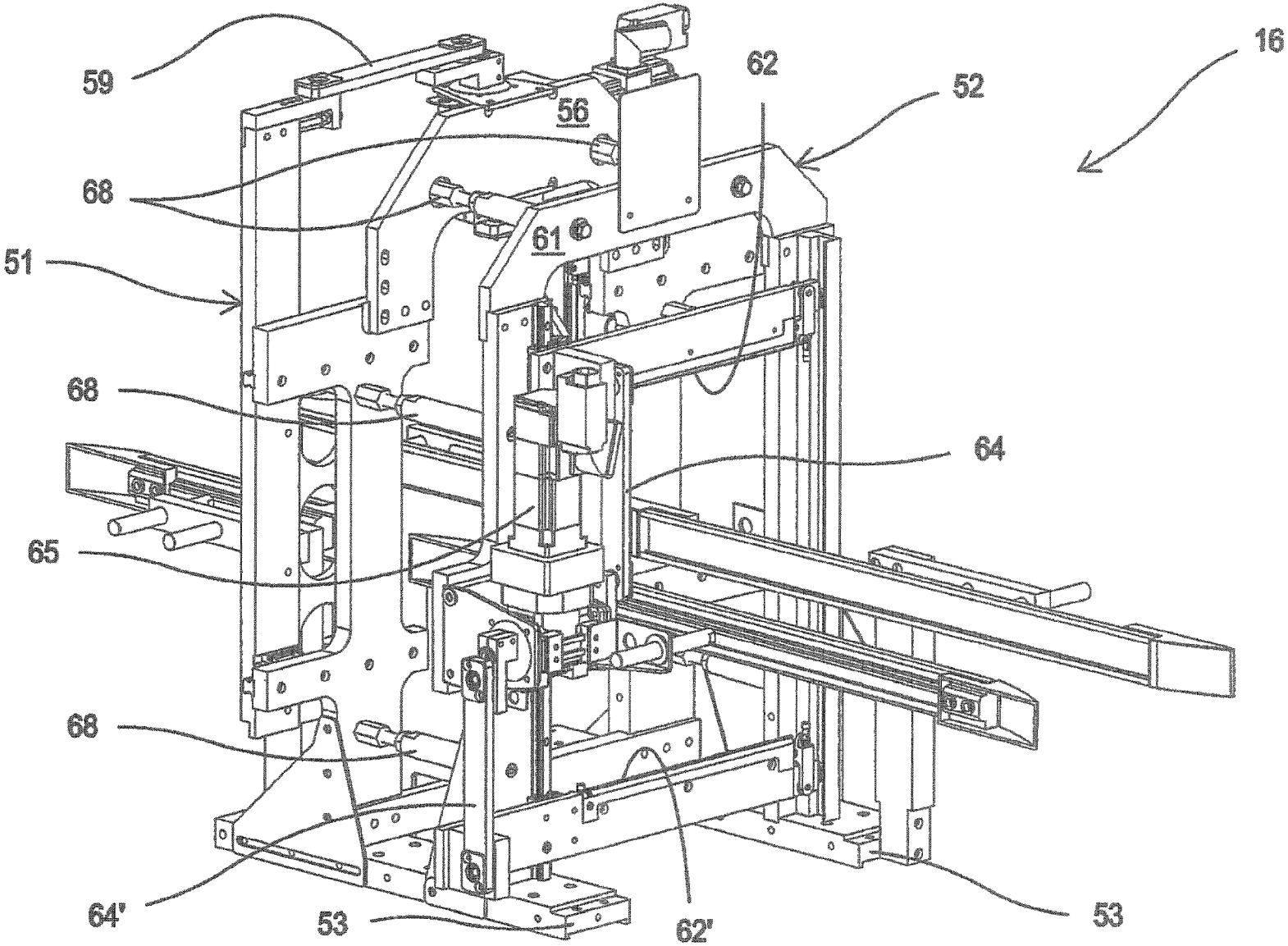
Figure 13:
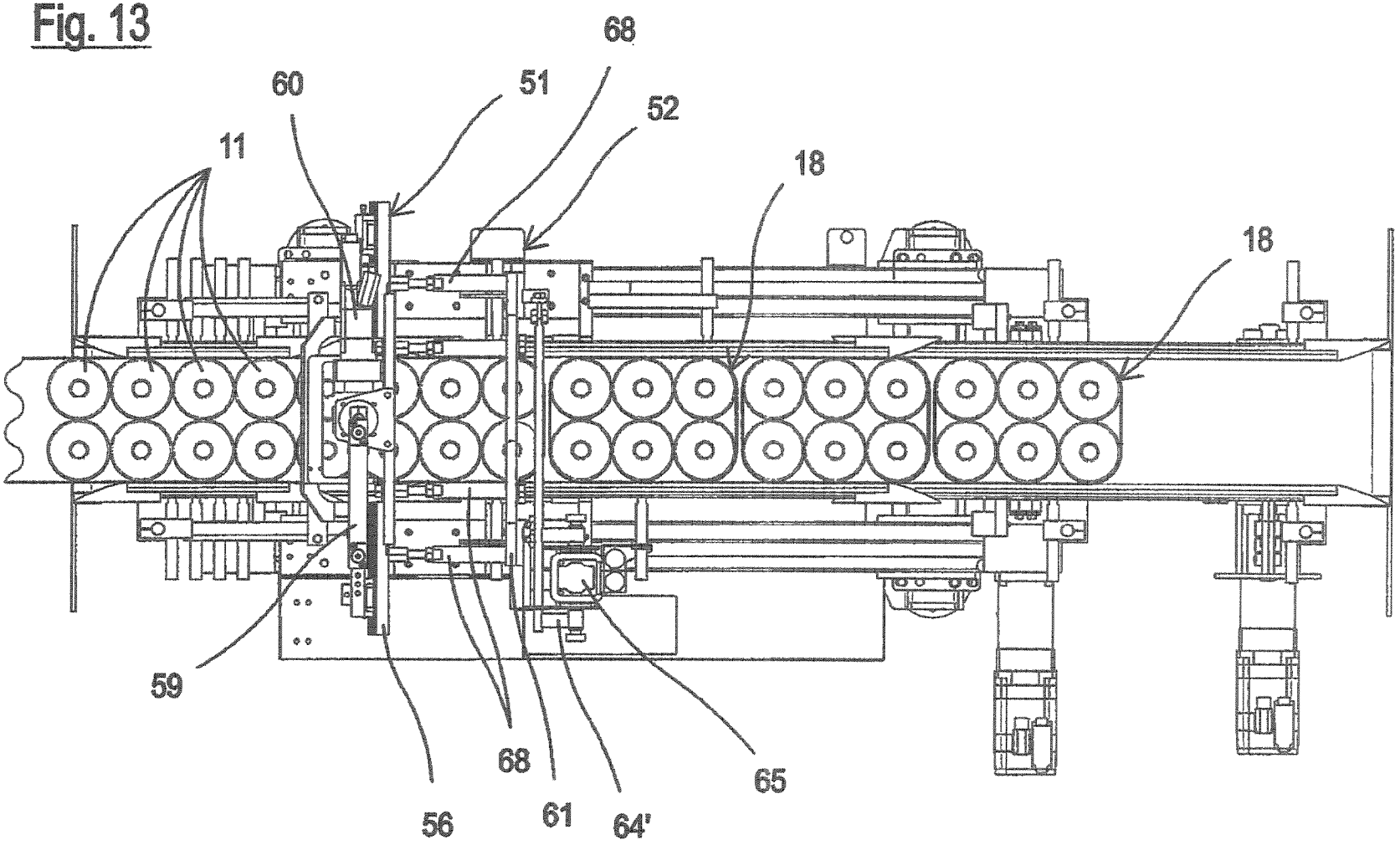
FIG. 13 is a plan view from above of the cutting unit of the previous FIGS. 10-12.

FIG. 8 shows the difference between the reciprocal arrangement between the reel-holder 37 and the reel of film 38 of extensible plastic material and the support 39 carrying the rubberized tensioning roller 40 and the pair of return rollers 41 for the film 17. It should in fact be remembered that the film unwound from the reel 38 in this second winding unit 15 is arranged with an opposite rotation direction with respect to that of the first winding unit 14 to intersect with the same, obtaining the stability of the continuous packaging or bundle.

A second connection module 44, identical to the first connection module 44 previously described, allows the connection of the second winding unit 15 with the cutting unit 16 which separates the continuous packaging or bundle being fed forwards into finished groups of products 11, i.e. single final packagings 18 contained in at least two layers of film made of extensible plastic material 17 wound according to opposite rotation directions.

This cutting unit 16 must intervene to separate the continuous packaging or bundle moving forwards thus formed into finished packagings 18, for example of six adjacent bottles 11 in pairs.

In a preferred embodiment, said cutting unit 16 comprises a frame 50 which supports it. The cutting unit 16 in the non-limiting example comprises a side cutting device 51 and an upper and lower cutting device 52. The cutting unit 16, in fact, acts on the plastic material wound in the continuous packaging or bundle around the bottles 11 to effect a cutting on four winding sections, two vertical and two horizontal, which form the perimeter of the continuous packaging or bundle.

The frame 50 carries a slide 53, free to move forwards and backwards, bearing the side cutting device and the upper and lower cutting device 52 on relative guides 67. Said slide 53 moves forwards and backwards beneath a conveyor belt 55 whose upper part is designed for being wound around end pulleys 54 and supports the various pairs of bottles 11 being packaged or continuous bundle which arrive wound in two layers of film arranged for being spirally crossed while moving forwards. The conveyor belt 55 consequently accompanies the various pairs of bottles wound in the single packaging or continuous bundle during the complete cutting step.

The side cutting device 51 provides a portal 56 containing two vertical side blades 57 movably positioned on horizontal guides 58 for moving forwards and backwards. In this way, the two vertical side blades 57 can be moved towards and away from the plastic material of the continuous packaging wound around the bottles 11 to effect a cutting on two vertical sections of said continuous packaging on opposite sides of said continuous packaging or bundle. The vertical blades are operatively subjected to voltage difference and heated by the current which is consequently generated and passes through them thus operating with a hot cut or in any case with alternative systems such as ultrasounds, etc.

The portal 56 is positioned astride on the continuous packaging or bundle of products 11 that moves forwards in the packaging machine.

The two vertical blades 57 are driven in this movement by a double crank mechanism 59, 59', upper and lower, actuated by a single motor 60.

The upper and lower cutting device 52 also provides a portal 61 containing two upper 62 and lower 62' horizontal blades movably positioned on vertical guides 63 for moving forwards and backwards on a vertical plane. In this way, the two horizontal blades 62, 62' can be moved towards and away from the continuous packaging or bundle comprising two layers of film wound in an opposite direction around the products to effect a cutting on two horizontal sections of said continuous packaging on opposite sides of the continuous packaging or bundle. Also in this case, the two horizontal blades 62, 62' are operatively subjected to voltage difference and heated by the current which is consequently generated and passes through them therefore operating with a hot cut or in any case with alternative systems such as ultrasounds, etc.

The two horizontal blades 62, 62' are driven in this movement by a double crank mechanism 64, 64', upper and lower, actuated by a single motor 65.

Furthermore, the lower blade 62' in its forward and backward, upward and downward movement moves in an omega-shaped loop formed in the belt 55, wherein said omega-shaped loop can be moved together with a slide 53 and with the upper and lower cutting device 52.

Figure 14:
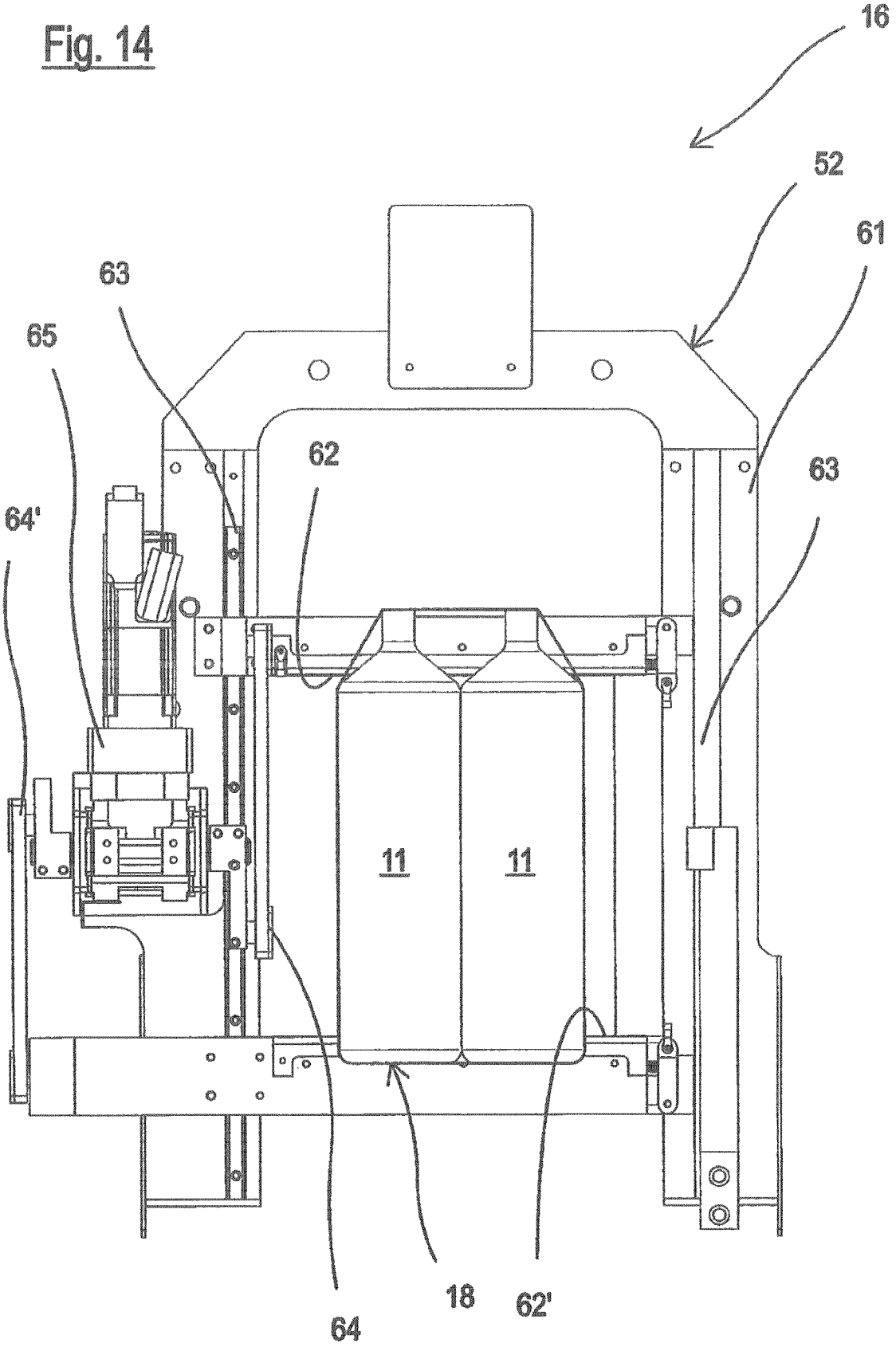
FIGS. 14 and 15 show sectional views in correspondence with the cutting unit with the upper and lower blades and side blades respectively, in an operating position acting on the film of plastic material that is enveloping the products.
Figure 15:
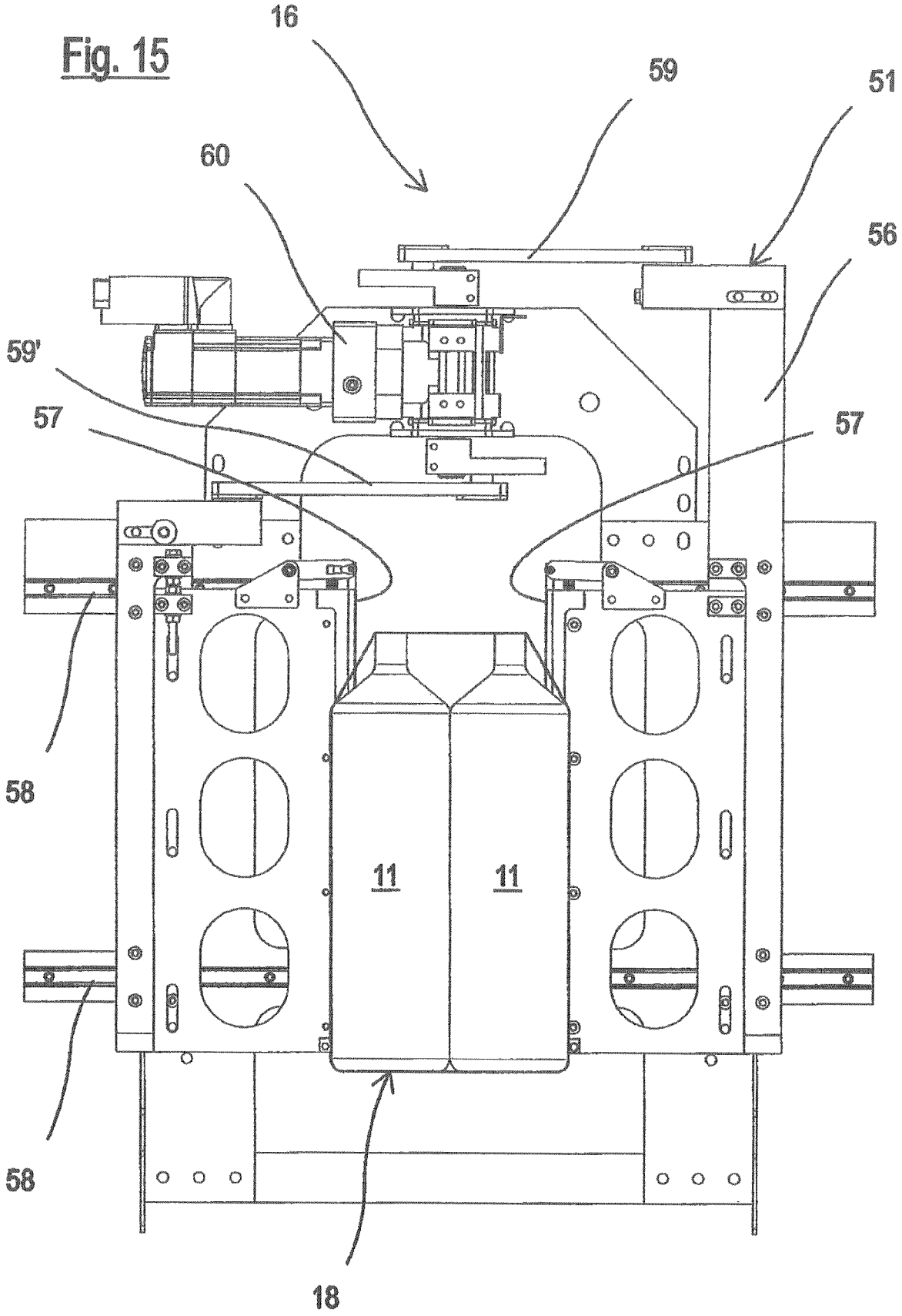

FIGS. 14 and 15 respectively show sectional views in correspondence with the upper and lower cutting device 52 of the cutting unit 16 with the upper 62 and lower 62' horizontal blades and side cutting device 51 with the vertical side blades 57 in an operational position acting on the film of plastic material that is being wound around the products.

The reciprocal distance d between the two portals 56 and 61 of the two side 51 and upper and lower 52 cutting devices is variable and adjustable in the setting phase of the machine with both a variation in the dimensions of the bottles 11 being packaged and above all in the quantity of bottles 11 required in the final packaging to be obtained. For this purpose, adjustable struts/rods 68 connect the two portals 56 and 61 of the two cutting devices 51 and 52 so that the reciprocal distance can be varied and regulated. With this arrangement, finished packagings can therefore be produced, for example with four or six bottles or another number or different dimensions.

The cutting unit 16 can be replicated various times in order to accelerate the separation operations of the packagings, increasing the productivity.

Figure 16:
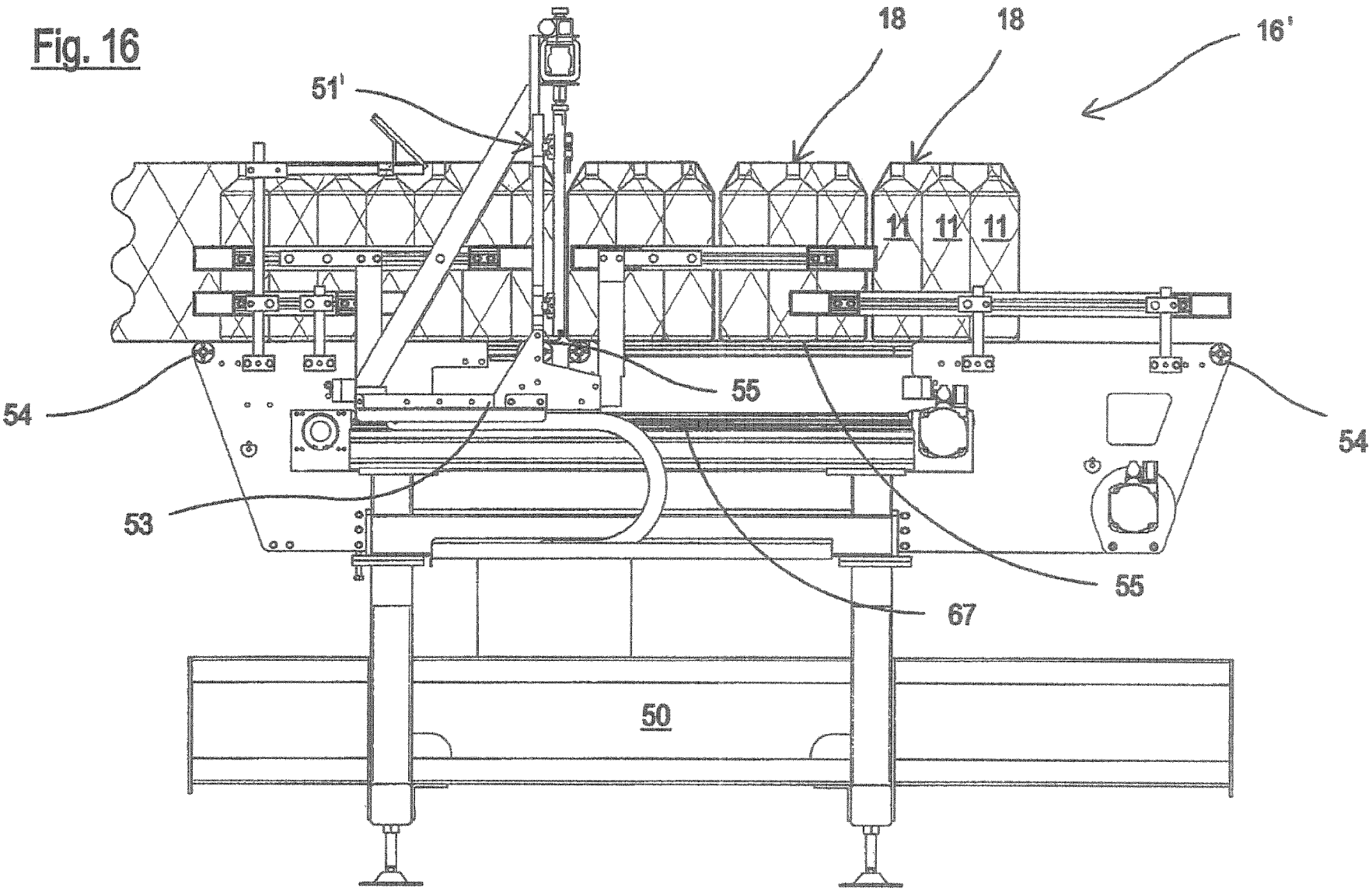
FIGS. 16 and 17 are a raised side view showing an alternative embodiment of a cutting unit forming part of the packaging machine and a sectional view in correspondence with the cutting unit of FIG. 16 with the side blades in an operating position acting on the whole film of plastic material that is enveloping the products.
Figure 17:
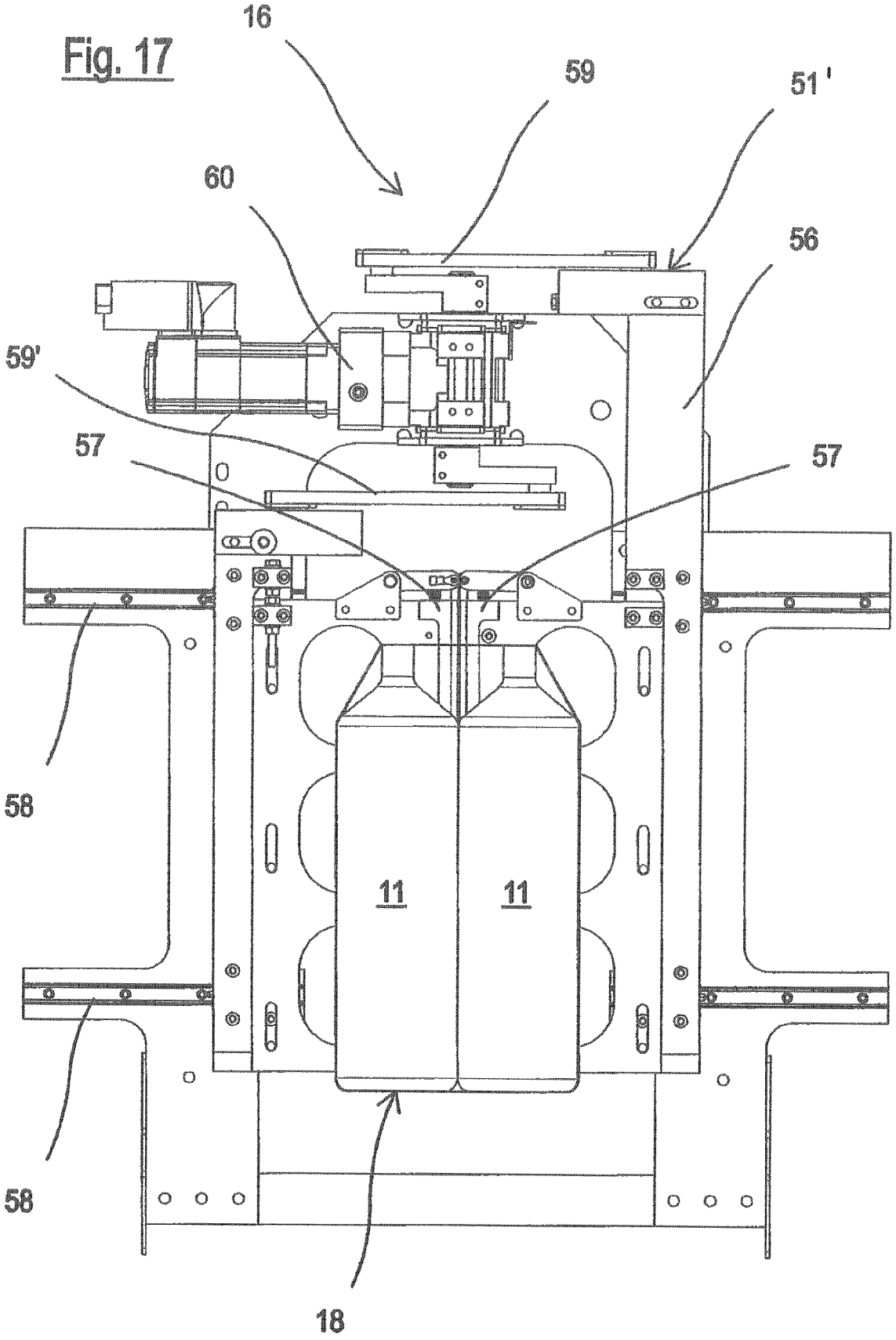

FIGS. 16 and 17 are a raised side view and a sectional view that show an alternative embodiment of a cutting unit 16' forming part of the packaging machine.

In this embodiment, the same elements are indicated with the same reference numbers.

Only one cutting device 51' is present, which provides side cutting blades 57. In this example, the side blades 57 slide until they reach the intermediate part of the two adjacent bottles 11 wound in the extensible film effecting a transversal cut of two opposite halves of said continuous packaging.

As clearly illustrated in the sectional view, in this cutting unit 16' of FIGS. 16 and 17, the side blades 57 in an operational position act on the film, passing halfway through the whole film of plastic material, which envelops the products, in order to produce the above-mentioned continuous packaging or bundle, so as to cut it transversally.

The cutting unit 16 can be replicated various times in order to accelerate the separation operations of the packagings, increasing the productivity.

In this machine of the invention, a new packaging method is also provided. A packaging method in extensible film of products 11 fed forwards in continuous in pairs of adjacent products, is in fact implemented. Said method comprises, in succession, a step for ordering two continuous rows of said adjacent products 11 and keeping them thus ordered. This is followed by a step for feeding and passing the products thus ordered into a first ring winding unit 14 of extensible film and winding the products 11 in a first film. Said winding is effected in a first rotation direction forming a continuous packaging or bundle. The products, already wound in the first winding unit with a first film is then moved forwards and fed to a second ring winding unit 15 of extensible film. Said winding is effected in a second film in a second rotation direction opposite to the first rotation direction thus forming a continuous packaging or bundle with two layers of film wound in opposite directions. The continuous packaging or bundle is subsequently moved forwards and fed into a cutting unit 16, which moves in synchrony with the continuous packaging or bundle. The cutting unit cuts the continuous packaging or bundle transversally into finished groups of products 11.

The packaging method provides that the movable cutting unit 16 cuts the continuous packaging or bundle of products by means of a transversal perimetric cut.

The packaging method also effects the step of selectively and alternately winding the products in the extensible film in the two ring winding units 14, 15 by means of one of two ring winding machines 32 provided for each of the two ring winding units 14, 15 thus effecting a continuous winding also in the exhaustion phase of the film in at least one of the two ring winding machines 32 provided for each of the two ring winding units 14, 15.

The functioning of a packaging machine in extensible film of products fed in continuous according to the invention is as follows.

As already specified, bottles 11 or different containers to be packaged into packagings having a pre-determined size and quantity are fed consecutively in compacted pairs on two continuous aligned and adjacent rows. The bottles 11 thus arranged are moved forwards up to a conveyor belt 12 for feeding the packaging machine as far as the inlet of the ordering unit 13.

A correct and constant reciprocal arrangement of the bottles 11 is obtained in this ordering unit 13, thanks to the presence of the two belts 21, 21' with adjacent dowels 26 protruding from one belt 21 towards the other opposite facing belt 21'.

The two continuous rows of bottles therefore acquire an absolutely uniform arrangement before being fed to the rest of the machine.

The bottles thus ordered and arranged as they pass, are sent into the first ring winding unit 14, in which, for example, one of the two ring winding machines 32 is active. The plastic film of the reel of this ring winding machine 32 is caused to rotate and to be wound around the bottles 11 moving forward on the shelf 29 and between the pairs of side guiding bars 30.

A continuous bundle of rows of pairs of bottles 11 is thus obtained, moving forwards with a certain tension of the film thanks to the specific means provided and previously described.

The bottles 11 thus wound leave the first winding unit 14 and, passing onto the further shelf 29, they reach the connection module 44 towards the subsequent second winding unit 15.

During the passage inside the first winding unit 14, the feeding is favored by the presence of two conveyor belts 42 and 43. Further conveyor belts spaced apart and superimposed 45 and 46 are provided in the connection module 44 to favor the forward movement of the continuous packaging or bundle of the rows of pairs of bottles 11.

Continuation of the feeding brings said continuous packaging or bundle towards the second winding unit 15 and, for example, above the respective shelf 29, the winding of the first of the two ring winding machines of the second winding unit 15 is actuated at the inlet. Also in this case, the plastic film of the reel of this ring winding machine 32 is caused to rotate and to be wound around the bottles 11 already wound by the first film moving forward on the shelf 29 and between the pairs of side guiding bars 30. It should be noted, however, that the rotation of the ring winding machine 32 in this case is effected in an opposite direction to the rotation of the first winding unit 14 so as to intersect the layers of film of the first winding with the layers of film of this second winding.

Said continuous packaging or bundle of pairs of bottles 11 thus formed with crossed layers of film continues to move forwards favored by the presence of two conveyor belts 42 and 43 provided inside the second winding unit 15 and further conveyor belts 45 and 46 provided in a second connection module 44 positioned before the inlet to the cutting unit 16.

The continuous bundle then passes onto the conveyor belt 55 positioned in the cutting unit 16 which supports and accompanies the continuous packaging or bundle during the complete cutting step.

The slide 53 containing the two side 51 and upper and lower 52 cutting devices moves to correlate with the advance rate of the continuous bundle and reach the cutting point.

The cutting is effected by the two devices when the relative rate between the slide 53 and bundle containing the bottles 11 is zero.

During a cutting step, the vertical side blades 57 of the side cutting device 51 act on a section of the continuous bundle, whereas the two upper 62 and lower 62' horizontal blades of the upper and lower cutting device 52 act on a different section of the continuous bundle.

The completion and separation of the finished packaging is effected when, as the continuous bundle continues to move forwards, the slide 53 has brought the cutting devices 51 and 52 back and has been reactivated in the advance direction of the continuous bundle returning to the same advance rate as the continuous bundle. It is in this situation, in fact, that the two cutting devices 51 and 52 re-operate and effect the respective vertical perimetric and horizontal cuts on the bundle, the horizontal cuts being effected this time where the vertical cuts had been effected, completing the perimetric cutting of the continuous packaging and separating the single packaging. This cutting unit 16 has been described, but another different cutting unit can be identically used without providing a packaging machine in extensible film of products fed in continuous which is different from that of the present invention.

An important feature of the machine of the present invention, in fact, lies in the possibility of effecting a continuous winding of pairs of bottles or products being packaged without any interruption. This is possible thanks to the provision of two ring winding machines 32 in each winding unit, the same but opposite, that operate selectively and alternately according to whether or not the film of the respective reel is running low. The possibility of always having winding film in one ring winding unit or in the other of each winding unit, in fact, avoids stoppages of the machine and allows the exhausted reel of one ring winding machine to be substituted when the other ring winding machine is operating. This is obtained by means of specific sensors which detect the approaching end of the film of a reel and which allow the advance starting of the second ring winding machine before the film of the first ring winding machine has terminated.

The objective mentioned in the preamble of the description has therefore advantageously been achieved.

A method and a machine are in fact provided for the packaging of products fed in continuous, which does not require any stoppage in the case of exhaustion of the winding film and packaging.

More than one cutting unit coupled with the winding units can also be provided, for example, with an increase in the hourly productivity. This is possible thanks to the high speeds that can be reached with the winding units and due to the fact that no stoppage is required for intervening on the film being fed for the winding.

A high velocity of this machine is also possible due to the fact that the cutting is effected peripherally with minimum movements of the blades which have extremely limited intervention times.

The forms of the structure for the provision of a machine and method of the present invention, as also the materials and assembly modes, can naturally differ from those shown for purely illustrative and non-limiting purposes in the drawings.

The protection scope of the present invention is defined by the enclosed claims.

The invention claimed is:

1. A packaging machine in extensible film of products fed forwards and continuously in pairs of adjacent products, comprising:

an ordering machine, which receives two continuous rows of said adjacent products and keeps said adjacent products ordered;

a first ring winding unit and a second ring winding unit, the second ring winding unit effecting a winding in an opposite direction with respect to a direction of the first ring winding unit;

a cutting unit of a continuous packaging or bundle thus formed to create finished groups of products, wound in the extensible film and forming a final packaging, wherein each ring winding unit comprises a frame, which, on opposite sides, supports a-two ring winding machines disposed thereon that are adapted to be selectively and alternately actuated, when a film reel of one of the two ring winding machines is running low, to form said continuous packaging or bundle without interrupting operation of the packaging machine, and wherein said two ring winding machines of said first ring winding unit rotate in an opposite direction with respect to said ring winding machines of said second winding unit.

2. The packaging machine according to claim 1, wherein said ordering machine positioned upstream of said first ring winding unit comprises two belts ring-wound around end pulleys arranged on respective vertical shafts, wherein one of said vertical shafts is motorized, said belts having spaced dowels protruding from one belt towards the other opposite belt and facing the other opposite belt, and wherein the one belt is spaced from the other opposite belt by a dimension equal to at least two adjacent products.

3. The packaging machine according to claim 1, further comprising a connection module positioned between said first ring winding unit and said second ring winding unit, said connection module comprising, in a frame, two conveyor belts spaced apart and superimposed, said two conveyor belts comprising a lower belt and an upper belt, and side guiding bars for receiving said two continuous rows of said adjacent products wound in a first film.

4. The packaging machine according to claim 1, wherein said cutting unit (16') comprises a side cutting device (51') acting on the extensible film, which forms said continuous packaging or bundle and is wound around said products (11) to effect a transverse cut of two opposite halves of said continuous packaging or bundle.

5. The packaging machine according to claim 4, wherein said cutting unit (16') comprises a slide (53) containing said side cutting devices (51'), wherein said slide (53) is positioned on guides (67) and slides forwards and backwards beneath a conveyor belt (55) which supports said continuous packaging or bundle.

6. The packaging machine according to claim 4, wherein said side cutting device (51') comprises a portal (56) containing two vertical side blades (57) movably positioned on horizontal guides (58) for moving forwards and backwards, towards and away from said continuous packaging or to effect a cut on two opposite halves of said continuous packaging or bundle.

7. The packaging machine according to claim 6, wherein said two vertical blades (57) are driven by a double crank mechanism (59, 59'), which comprises an upper and a lower crank mechanism, actuated by a single motor (60).

8. A packaging machine in extensible film of products fed forwards and continuously in pairs of adjacent products, comprising:

an ordering machine, which receives two continuous rows of said adjacent products and keeps said adjacent products ordered;

a first ring winding unit and a second ring winding unit, the second ring winding unit effecting a winding in an opposite direction with respect to a direction of the first ring winding unit;

a cutting unit of a continuous packaging or bundle thus formed to create finished groups of products, wound in the extensible film and forming a final packaging, wherein each ring winding unit comprises a frame, which, on opposite sides, support two ring winding machines that are adapted to be selectively and alternately actuated to form said continuous packaging or bundle, wherein said two ring winding machines of said first ring winding unit rotate in an opposite direction with respect to said ring winding machines of said second winding unit, and wherein said cutting unit of the continuous packaging or bundle comprises a side cutting device and an upper and lower cutting device, said side cutting device, and said upper and lower cutting device being spaced from each other along a direction of movement of the pairs of adjacent products and acting on the extensible film wound around said products to effect a cut on four winding sections, said four winding sections comprising two vertical and two horizontal sections, and wherein said four winding sections form a perimeter of the continuous packaging or bundle.

9. The packaging machine according to claim 8, wherein said cutting unit comprises a slide containing said side cutting device and said upper and lower cutting device, wherein said slide is positioned on guides and slides forwards and backwards beneath a conveyor belt which supports said continuous packaging or bundle wound in two layers of the extensible film arranged spirally crossed while said continuous packaging or bundle is moving forwards.

10. The packaging machine according to claim 8, wherein said side cutting device comprises a portal containing two vertical side blades movably positioned on horizontal guides for moving forwards and backwards, towards and away from said continuous packaging or bundle to effect a cut on the two vertical sections of said continuous packaging or bundle on opposite sides of said continuous packaging or bundle.

11. The packaging machine according to claim 10, said two vertical blades are driven by a double crank mechanism which comprises an upper and a lower crank mechanism, actuated by a single motor.

12. The packaging machine according to claim 8, wherein said upper and said lower cutting device comprise a portal having two horizontal upper and lower blades movably positioned on vertical guides to move forwards and backwards on a vertical plane towards and away from said continuous packaging or bundle to effect a cut on the two horizontal sections of said continuous packaging or bundle on opposite sides of said continuous packaging or bundle.

13. The packaging machine according to claim 12, wherein said horizontal blades are driven by a double crank mechanism, which comprises an upper and a lower crank mechanism, actuated by a single motor.

* * * * *